US009059535B2

(12) United States Patent
Gong et al.

(10) Patent No.: US 9,059,535 B2
(45) Date of Patent: Jun. 16, 2015

(54) EASY-INSTALLATION AND MAINTENANCE WATERPROOF SOCKET AND PLUG ASSEMBLY

(75) Inventors: Shugang Gong, Shenzhen (CN); Lei Peng, Shenzhen (CN); Huabin Xie, Shenzhen (CN); Guofang Wu, Shenzhen (CN); Shaorong Lin, Shenzhen (CN); Tao Huang, Shenzhen (CN); Shanjing Zhu, Shenzhen (CN)

(73) Assignee: FOSHAN SHANRI MOTOR ELECTRIC HUB CO., LTD., Shenzhen (CN)

( * ) Notice: Subject to any disclaimer, the term of this patent is extended or adjusted under 35 U.S.C. 154(b) by 179 days.

(21) Appl. No.: 13/821,831

(22) PCT Filed: Sep. 7, 2011

(86) PCT No.: PCT/CN2011/079449

§ 371 (c)(1),
(2), (4) Date: May 1, 2013

(87) PCT Pub. No.: WO2012/031555

PCT Pub. Date: Mar. 15, 2012

(65) Prior Publication Data

US 2013/0224980 A1 Aug. 29, 2013

(30) Foreign Application Priority Data

Sep. 8, 2010 (CN) ..... 2010 1 0277785

(51) Int. Cl.
*H01R 13/52* (2006.01)
*H01R 13/11* (2006.01)

(Continued)

(52) U.S. Cl.
CPC ..... *H01R 13/5202* (2013.01); *H01R 13/748* (2013.01); *H01R 13/111* (2013.01); *H01R 13/523* (2013.01)

(58) Field of Classification Search
CPC ..... H01R 13/6215; H01R 13/6395; H01R 13/658; H01R 13/5219; H01R 13/5202; H01R 13/521
USPC ..... 439/362, 271
See application file for complete search history.

(56) References Cited

U.S. PATENT DOCUMENTS

| | | | | |
|---|---|---|---|---|
| 7,950,942 | B2 * | 5/2011 | Klinger et al. | 439/247 |
| 8,167,634 | B2 * | 5/2012 | Fujiwara et al. | 439/271 |
| 8,231,399 | B2 * | 7/2012 | Daubigney | 439/316 |

(Continued)

FOREIGN PATENT DOCUMENTS

| | | |
|---|---|---|
| CN | 1477735 | 2/2004 |
| CN | 101170236 | 4/2008 |

(Continued)

*Primary Examiner* — Gary Paumen
(74) *Attorney, Agent, or Firm* — Hamre, Schumann, Mueller & Larson, P.C.

(57) ABSTRACT

An easy-installation and maintenance waterproof socket and plug assembly comprising a socket (2) and a plug (1), wherein a recess is disposed in the socket (2) for containing the plug (1), a plurality of convex connection terminals (21, 22) are set on a bottom of the recess, the connection terminals (21, 22) are connected to an external control panel (200) through conductive sheets (201, 202) sleeved inside the connection terminals (21, 22), the plug (1) is provided with hole positions corresponding to the connection terminals of the socket, the hole positions are provided with metal connection spring sheets (11, 12).

11 Claims, 2 Drawing Sheets

(51) Int. Cl.
*H01R 13/74* (2006.01)
*H01R 13/523* (2006.01)

(56) References Cited

U.S. PATENT DOCUMENTS 8,257,102 B2 * 9/2012 Delgado et al. ..... 439/247
8,491,323 B2 * 7/2013 Ishibashi ..... 439/205

FOREIGN PATENT DOCUMENTS

| | | |
|---|---|---|
| CN | 101499585 | 8/2009 |
| CN | 102013589 | 4/2011 |
| CN | 102013590 | 4/2011 |
| CN | 201789117 | 4/2011 |
| CN | 201877595 | 6/2011 |
| DE | 202004017255 | 1/2006 |

* cited by examiner

EASY-INSTALLATION AND MAINTENANCE WATERPROOF SOCKET AND PLUG ASSEMBLY

TECHNICAL FIELD

The present invention relates to a socket and plug assembly, and more particularly, to an easy-installation and maintenance waterproof socket and plug assembly.

BACKGROUND

The present waterproof socket and plug for transferring voltage, current and information are independent component. The plug is connected with the cable through a sealing member or a whole injection or glue injecting. The socket is connected with the sealed box or box case with a sealing structure. When there is a need, the socket and plug are tightly connected to be used. When the box works, the voltage, current or information outside the box are distributed to the socket through the plug, and then transferred to a voltage, current or information receiving device in the box (the control panel in the box) via the wire. On the contrary, the voltage, current or information in the box are distributed to the plug through the socket, and then transferred to a voltage, current or information receiving device outside the box via the cable.

To maintain the box easily, the length of the wire connecting the voltage, current or information receiving or transmitting device in the box and the socket must be long enough. So when the voltage, current or information using device is moved outside the sealed box, the voltage, current or information receiving device may not be limited by the wire. When the voltage, current or information receiving or transmitting device is fixed in the box and when the kind and the value of the receiving or transmitting voltage, the kind and the value of the receiving or transmitting voltage or the kind of the information is different, the number of the wire connecting the voltage, current or information receiving or transmitting device and the waterproof socket will be increased. So the difficulty in the fixture and anti-interference performance of the voltage, current or information transporting wire in the sealed box increases, and the wire also takes the space of the box. For the present waterproof socket and plug for transferring voltage, current and information, the connections between the socket and the sealed box and the sealed box case, between plug and cable and between socket and plug are occupied big space. So the present waterproof socket and plug is not suitable for the technology requirement of small volume, light weight and high reliability.

SUMMARY

To solve the problem mentioned above, the present invention provides an easy-installation and maintenance waterproof socket and plug assembly.

The provided easy-installation and maintenance waterproof socket and plug assembly comprises a socket and a plug, wherein a recess is disposed in the socket for containing the plug, a plurality of convex connection terminals are set on a bottom of the recess, the connection terminals are connected to an external control panel through conductive sheets sleeved inside the connection terminal, the plug is provided with hole positions corresponding to the connection terminals of the socket, the hole positions are provided with metal connection spring sheets.

Further, the socket and plug are provided with a corresponding horizontal protruding edge on the connection side, two horizontal protruding edges are fixed with a bolt.

Further, the horizontal protruding edge of the socket is provided with a groove, a sealing loop is disposed in the groove.

Further, the side wall of the recess in the socket is provided with an inner concave surface, a sealing circle is disposed in the inner concave surface.

Further, the sealing circle is provided with a sealing clamping ring for limiting position, the sealing clamping ring is an inverted L in shape, a horizontal part of the sealing clamping ring is hung onto an upper end of the open of the recess in the socket, a side of a vertical part of the sealing clamping ring facing to an inner concave surface is provided with a clamping protruding edge, an L shape clamping groove is disposed on the inner concave surface.

Further, an upper end of the clamping protruding edge of the sealing clamping ring is provided with a protruding boss.

Further, sealing convex rings are formed on the vertical part of the sealing clamping ring facing to the plug and the inner concave surface.

Further, an upper part of the vertical part of the sealing clamping ring facing to the plug is provided with a clamping groove for fixing.

Further, a high and low temperature resistance filling glue is filled between sealing clamping ring and the inner concave surface.

Further, a cable is drawn out of the plug through a sealing member or a whole injection or glue injecting.

In the present invention, the easy-installation and maintenance waterproof socket and plug assembly is using an embedded connection structure. The metal connection spring sheets is disposed in the plug, the convex connection terminals are disposed in the socket, the convex connection terminals comprise a groove, the convex connection terminals are connected to the external control panel by installing conductive sheets in the grooves. So more than one conductive metal flat with spring member of the voltage, current or information receiving or transmitting device in the sealed box and the plug of the present invention may insert in a socket. The inserting connection between inside box and outside box may be achieved. The mounting procedure of the voltage, current or information receiving or transmitting device in the sealed box is simplified. The volume of the sealed box is decreased and the anti-interference performance of the voltage, current or information receiving or transmitting device in the sealed box is improved.

DETAILED DESCRIPTION OF THE PREFERRED EMBODIMENTS

A detailed description of embodiments of the invention is displayed hereafter in connection with the accompanying drawings.

Figure 1:
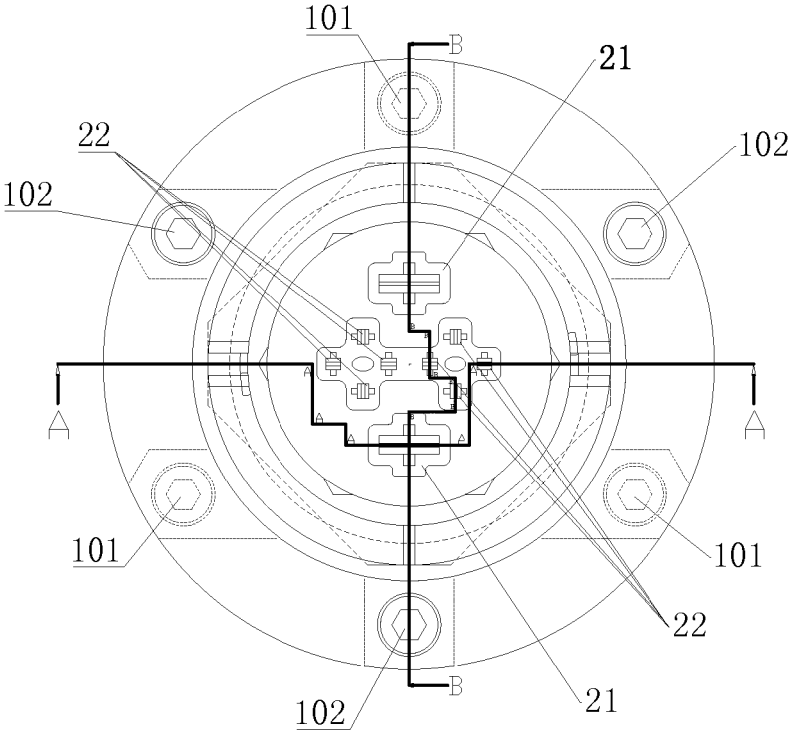
FIG. 1 is a top view of the easy-installation and maintenance waterproof socket and plug assembly according to an embodiment of the present invention.
Figure 2:
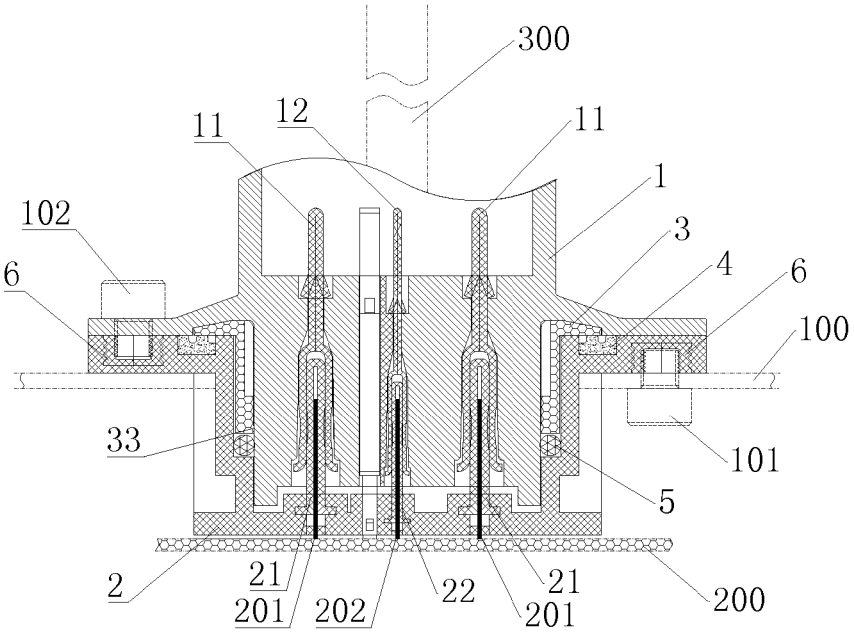
FIG. 2 is a sectional view of the easy-installation and maintenance waterproof socket and plug assembly along the B-B direction according to the embodiment of the present invention.
Figure 3:
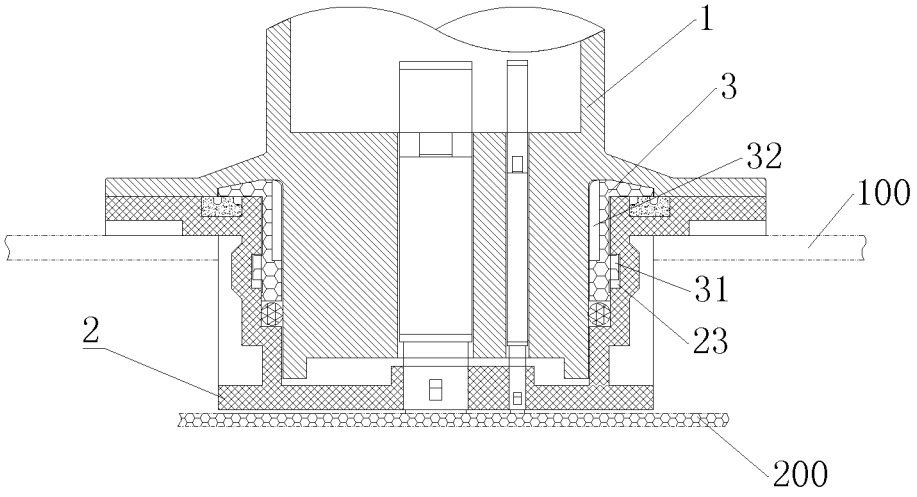
FIG. 3 is a sectional view of the easy-installation and maintenance waterproof socket and plug assembly along the A-A direction according to the embodiment of the present invention.
Figure 4:
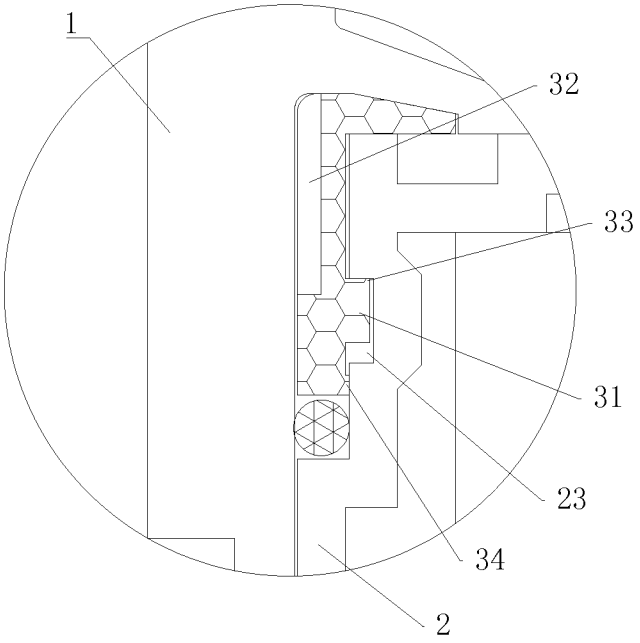
FIG. 4 is a partially enlarged view of the easy-installation and maintenance waterproof socket and plug assembly according to the embodiment of the present invention.

Referring to FIGS. 1-4, the easy-installation and maintenance waterproof socket and plug assembly includes a plug 1 and a socket 2. The plug 1 and socket 2 are made of non-metal material or the combination of the metal and non-metal material. A recess is disposed in the socket 2 for containing the plug 1. A first convex connection terminal 21 and more than one second convex connection terminals 22 are convexly disposed on the bottom of the recess. The first connection terminal 21 and the second connection terminal 22 are connected to an external control panel 200 through a first conductive sheet 201 and more than one second conductive sheet 202 sleeved inside the first connection terminal 21 and the second connection terminal 22 respectively. The first connection terminal 21 and the second connection terminal 22 include a spring structure in the horizontal direction. The spring structure may be a speaker shape spring sheet or a slippery tongue structure. So the spring structure may be electrically connected with the first connection terminal 21 and the second connection terminal 22 of the socket in any angle and direction. The plug 1 is provided with hole positions corresponding to the connection terminals 21 and 22 of the socket, the hole positions are provided with a first metal connection spring sheet 11 and a second metal connection spring sheet 12. A cable 300 is drawn out of the plug 1 through a sealing member or a whole injection or glue injecting.

In some embodiments of the present invention, the number of the first connection terminal 21 and the second connection terminal 22 in the socket is determined according to the requirement. In some embodiments, only the first connection terminal is disposed in the socket or only the second connection terminal is disposed in the socket. And if the number of the first connection terminal 21 and the second connection terminal 22 in the socket is changed, the number of the first conductive sheet 201, the second conductive sheet 202, the first metal connection spring sheet 11 and the second metal connection spring sheet 12 are changed accordingly.

The control panel 200 in the box 100 may be disposed in any place in the box. The corresponding socket 2 may be disposed on the box 100. The socket and the box are connected by inserting the first conductive sheet 201 and the second conductive sheet 202 into the first connection terminal 21 and the second connection terminal 22. The wire connecting the voltage, current or information receiving or transmitting device in the box and the socket is not needed. The mounting procedure of the voltage, current or information receiving or transmitting device in the sealed box is simplified. The volume of the sealed box is decreased and the anti-interference performance of the voltage, current or information receiving or transmitting device in the sealed box is improved.

To ensure a good combination strength and waterproof property between the plug 1 and the socket 2 the socket and plug are provided with a corresponding horizontal protruding edge on the connection side. Two horizontal protruding edges are fixed with a bolt 102. The horizontal protruding edge of the socket is provided with a groove. A sealing loop 4 is disposed in the groove. The upper surface of one of the horizontal protruding edge for the socket is provided with a nut insert 6, the bottom surface of another one of the horizontal protruding edge for the socket is provided with a nut insert 6. Through the nut insert the socket is fixed on the box by the bolt 101. The socket is connected with the horizontal protruding edge of the plug 1 through the bolt 102.

The seal between the plug 1 and socket 2 is achieved through the connected plug 1 and socket 2 and a sealing circle between the plug 1 and socket 2. Disposing directly the seal on the socket is hard to assemble. In some embodiments, the side wall of the recess in the socket 2 is provided with an inner concave surface, the sealing circle 5 is disposed in the inner concave surface. A sealing clamping ring 3 is disposed on the sealing circle 5. The sealing circle 5 is limited by the sealing clamping ring 3. To provide a stable combination, referring to FIG. 4, the side of the sealing clamping ring 3 facing to the inner concave surface is provided with a clamping protruding edge 31. The clamping protruding edge is provided with a protruding boss 33. An L shape clamping groove is disposed on the inner concave surface. The upper part of the vertical part of the sealing clamping ring facing to the plug is provided with a clamping groove 32 for fixing. When assembled, the sealing clamping ring 3 is inserted along the L shape clamping groove in the socket and is fixed through the clamping groove 32 by screwing a special spanner.

The profile of the sealing clamping ring 3 is with an inverted L shape. The horizontal part of the sealing clamping ring is hung onto the upper end of the open of the recess in the socket. Sealing convex rings 34 are formed on the vertical part of the sealing clamping ring facing to the plug and the inner concave surface. A high and low resistance filling glue is filled between sealing clamping ring and the inner concave surface. After the sealing clamping ring 3 and the socket 2 is connected through the clamping protruding edge 31 of the sealing clamping ring 3 and the clamping groove 23 of the socket, under the action of the sealing convex ring 34 the high and low temperature resistance filling glue filled between sealing clamping ring 3 and the socket 2 is blocked. So the structure may avoid the high and low resistance filling glue flowering out from the sealing convex ring 34 in the circle direction. Therefore the high and low resistance filling glue may effectively act the function of sealing and fixing.

The sealing circle 5 is a sealing member for the plug 1 and socket 2, the number of the sealing circle 5 is more than one. The sealing circles are disposed on the lower end of the inner concave surface under the sealing clamping ring 3. The other function of the sealing clamping ring 3 is used to fix the sealing circle 5. In some embodiments of the present invention, the sealing circle 5 may be a sealing circle group including a plurality of sealing circles The external control panel 200 may be provided with a Hall circuit board having a Hall component. The connection procedure is described below. When the plug is assembled, the circuit is opened. The plug is moved downward, the connection terminals of the plug contact the connection terminals of the socket successively. And the circuit is still open. When the connection terminals of the plug contact the connection terminals of the socket adequately, the Hall component is turned on and the circuit is closed. The disconnection procedure is contrary. When the plug is pulled out (the connection terminals are still connected), the Hall component is opened and the circuit is opened. During the connection and disconnection procedure, the connection terminals of the socket may be inserted with electric radiation resistance rubber rings. The electric radiation resistance principle is as followed. When the connection terminals of the plug are disconnected with the connection terminals of socket, the connection terminals of the plug have sleeved by the electric radiation resistance rubber rings of the socket, the electric spark is isolated by the rubber ring. The disconnection procedure is similar with the connection procedure.

The present invention is not limited by the above embodiment. It should be understood that various alternatives made by the person skilled in the art to the embodiments of the invention described herein may be employed in practicing the invention.

What is claimed is:

1. An easy-installation and maintenance waterproof socket and plug assembly comprising a socket and a plug, wherein a recess is disposed in the socket for containing the plug, a plurality of convex connection terminals are set on a bottom of the recess, the connection terminals are connected to an external control panel through conductive sheets sleeved inside the connection terminal, the plug is provided with hole positions corresponding to the connection terminals of the socket, the hole positions are provided with metal connection spring sheets, wherein the side wall of the recess in the socket is provided with an inner concave surface, a sealing circle is disposed in the inner concave surface, and wherein the sealing circle is provided with a sealing clamping ring for limiting position, the sealing clamping ring is an inverted L in shape, a horizontal part of the sealing clamping ring is hung onto an upper end of the open of the recess in the socket, a side of a vertical part of the sealing clamping ring facing to an inner concave surface is provided with a clamping protruding edge, an L shape clamping groove is disposed on the inner concave surface.

2. The easy-installation and maintenance waterproof socket and plug assembly of claim 1, wherein the socket and plug are provided with a corresponding horizontal protruding edge on the connection side, two horizontal protruding edges are fixed with a bolt.

3. The easy-installation and maintenance waterproof socket and plug assembly of claim 2, wherein the horizontal protruding edge of the socket is provided with a groove, a sealing loop is disposed in the groove.

4. The easy-installation and maintenance waterproof socket and plug assembly of claim 1, wherein a high and low temperature resistance filling glue is filled between sealing clamping ring and the inner concave surface.

5. The easy-installation and maintenance waterproof socket and plug assembly of claim 1, wherein an upper end of the clamping protruding edge of the sealing clamping ring is provided with a protruding boss.

6. The easy-installation and maintenance waterproof socket and plug assembly of claim 5, wherein a high and low temperature resistance filling glue is filled between sealing clamping ring and the inner concave surface.

7. The easy-installation and maintenance waterproof socket and plug assembly of claim 5, wherein sealing convex rings are formed on the vertical part of the sealing clamping ring facing to the plug and the inner concave surface.

8. The easy-installation and maintenance waterproof socket and plug assembly of claim 7, wherein a high and low temperature resistance filling glue is filled between sealing clamping ring and the inner concave surface.

9. The easy-installation and maintenance waterproof socket and plug assembly of claim 7, wherein an upper part of the vertical part of the sealing clamping ring facing to the plug is provided with a clamping groove for fixing.

10. The easy-installation and maintenance waterproof socket and plug assembly of claim 9, wherein a high and low temperature resistance filling glue is filled between sealing clamping ring and the inner concave surface.

11. The easy-installation and maintenance waterproof socket and plug assembly of claim 1, wherein a cable is drawn out of the plug through a sealing member or a whole injection or glue injecting.

* * * * *

UNITED STATES PATENT AND TRADEMARK OFFICE

CERTIFICATE OF CORRECTION

PATENT NO. : 9,059,535 B2
APPLICATION NO. : 13/821831
DATED : June 16, 2015
INVENTOR(S) : Gong et al.

It is certified that error appears in the above-identified patent and that said Letters Patent is hereby corrected as shown below:

Title page of the patent, (73), after Assignee: "FOSHAN SHANRI MOTOR ELECTRIC HUB CO., LTD." should read --SHENZHEN ZHIYOU BATTERY INTEGRATION TECHNOLOGY CO, LTD.--.

Signed and Sealed this
Seventh Day of June, 2016

Michelle K. Lee

Michelle K. Lee
*Director of the United States Patent and Trademark Office*